US005271506A

United States Patent [19]

Haines

[11] Patent Number: 5,271,506

[45] Date of Patent: Dec. 21, 1993

[54] APPARATUS FOR SEPARATING FRUITS OR VEGETABLES FROM DEBRIS

[75] Inventor: Carroll L. Haines, Avoca, N.Y.

[73] Assignee: Haines Equipment, Inc., Avoca, N.Y.

[21] Appl. No.: 2,145

[22] Filed: Jan. 11, 1993

[51] Int. Cl.[5] ..... B07C 5/00

[52] U.S. Cl. ..... 209/640; 209/637

[58] Field of Search ..... 209/631, 637, 638, 640, 209/642, 699

[56] References Cited

U.S. PATENT DOCUMENTS

| | | | |
|---|---|---|---|
| 4,373,638 | 2/1983 | Schapper | 209/642 X |
| 4,375,853 | 3/1983 | Feller et al. | 209/640 |
| 4,744,470 | 5/1988 | Feller et al. | 209/640 |

FOREIGN PATENT DOCUMENTS

| | | | |
|---|---|---|---|
| 0128614 | 6/1950 | Sweden | 209/637 |
| 1502139 | 8/1989 | U.S.S.R. | 209/638 |

*Primary Examiner*—H. Grant Skaggs
*Assistant Examiner*—Carol L. Druzbick
*Attorney, Agent, or Firm*—Michael F. Brown; Ralph R. Barnard; Christopher A. Michaels

[57] ABSTRACT

An improved apparatus for sorting agricultural products such as vegetables or fruits from dirt clods, rocks, or other debris, without bruising the desired product. The mixture of desired product and undesired debris is transported by conveyor and allowed to fall freely on a rotating roller. The individual components rebound differentially from the roller, separating the product and the debris. The roller is constructed of a loose-fitting sleeve supported and rotated by resilient disks on a rotating shaft, with the resilience of the disks minimizing the bruising of the product rebounding from the roller.

27 Claims, 3 Drawing Sheets

APPARATUS FOR SEPARATING FRUITS OR VEGETABLES FROM DEBRIS

FIELD OF THE INVENTION

The invention pertains to the field of apparatus for processing harvested agricultural products. More particularly, the invention pertains to devices for separating new harvested agricultural products from dirt, rocks or other debris picked up in the harvesting process.

BACKGROUND OF THE INVENTION

When certain fruits or vegetables are harvested, especially underground vegetables such as potatoes or the like, the harvesting machinery is likely to include significant quantities of dirt clods and/or rocks in with the desired product. It then becomes necessary to separate the desired product from the undesired dirt, rocks or other debris.

This separation can be accomplished manually, by having workers pick the vegetables out from the debris as they pass by on a conveyor. In order to eliminate this hard, tedious manual labor, a number of machines have been devised over the years. Feller, U.S. Pat. No. 4,375,853, issued in 1983, contains a description of the prior art in this field, and presents one of the better solutions to the problem.

In Feller's '853 device, the mixture of desired product (potatoes) and undesired debris (dirt clods) is conveyed to a free-fall area, where it falls onto a rotating steel roller. The components of the mixture bounce off the roller in varying degrees, depending on the characteristics of the individual components. Obviously, potatoes bounce more than dirt. This separates the stream of mixed material into two streams, which can then be collected separately. This device has the drawback, however, that bouncing off a steel roller can bruise the product. If one is harvesting potatoes to be dried or powdered, this does not matter, but if one is interested in preserving the fruit or vegetable involved for sale as whole product it becomes important to avoid bruising as much as possible.

Feller's later U.S. Pat. No. 4,744,470, issued in 1988, is a refinement of the '853 patent, with the intention of improving separation of rocks from the potatoes. In the '470 patent, Feller discloses the use of a rebound surface which absorbs more kinetic energy from hard objects, such as rocks, and less from soft objects, such as potatoes. One embodiment (FIG. 3) shows a roller which has a steel core covered with a thin layer of foam, with an impact surface made of a plurality of stainless steel rings. This variation on the original Feller device does little or nothing to minimize the bruising of the product, as can be seen in column 2, lines 41–45: ". . . the impact surface is stiff enough to be generally unaffected by the impact thereon of softer agricultural products, which rebound therefrom, as from a rigid surface."

SUMMARY OF THE INVENTION

The invention provides an improved separation roller for a separating device of the kind described in the Feller patents, which significantly reduces the bruising associated with the impact of the agricultural product with the roller. The roller is constructed of a shaft for supporting and rotating the roller, which is covered in the impact area by resilient material, which is in turn covered with a loose-fitting rigid sleeve which is free to move radially against the resistance of the disks under the impact of the product. The disks comprise a substantial portion of the thickness of the roller, and the motion of the sleeve against the disks cushions the product against the impact of the roller and minimizes bruising.

DESCRIPTION OF THE PREFERRED EMBODIMENT

Figure 1:
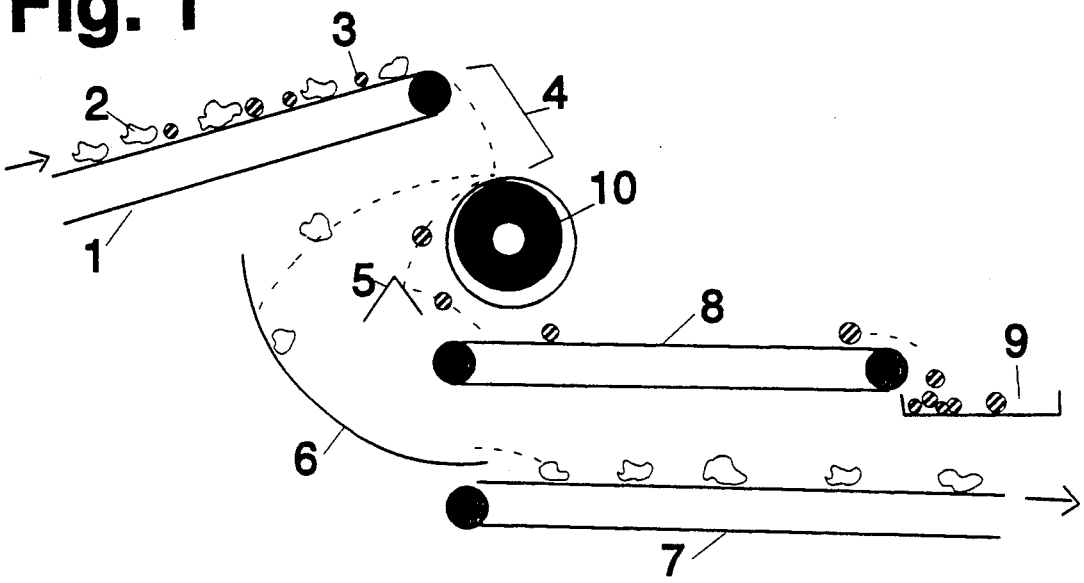
FIG. 1 shows a diagram of the complete device, including the improved roller of the INVENTION.

In all of the figures, identical reference numerals are used to denote identical elements.

FIG. 1 shows a device for separating an agricultural product, such as fruits or vegetables such as potatoes, from dirt, rocks and other undesirable debris which may be gathered along with the desired product, which device incorporates the improved roller of the invention.

Referring to FIG. 1, a mixture of vegetables such as potatoes or the like (irregular items (2)) and rocks or dirt clods (lined circles (3)) are introduced into the device using a feed conveyor (1). The mixture falls off the end of the feed conveyor (1) into free-fall zone (4), where it falls freely under the influence of gravity, as shown by the dotted lines in the figure. The mixture falls onto the separating roller (10), which is rotated by any conventional drive means (not shown) such as a power take-off on a tractor, or an electric or hydraulic motor.

The mixture of product and debris falls onto and rebounds from the roller (10). Because of the differing characteristics of the desired product (2) and the undesirable debris (3), the mixture is separated into two streams of components, again as shown by the dotted lines, which then are collected by conventional collection means. In the embodiment shown, a diverter (5) helps in further delineating between the two streams. The diverter (5) is preferably adjustable in location, so as to most accurately discriminate between desired and undesired streams. The debris is shunted onto a conveyor (8) which transfers it into a collector of some sort (9) for disposal. The product rebounds further than the debris, and slides down a chute (6) and onto another conveyor (7) which transports it on to further processing or packing.

Figure 2:
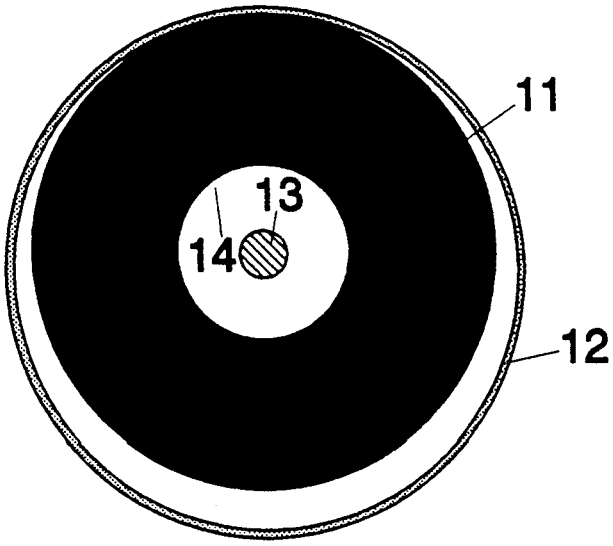
FIG. 2 shows a cut-away end view of the preferred embodiment of the roller of the invention.
Figure 3:
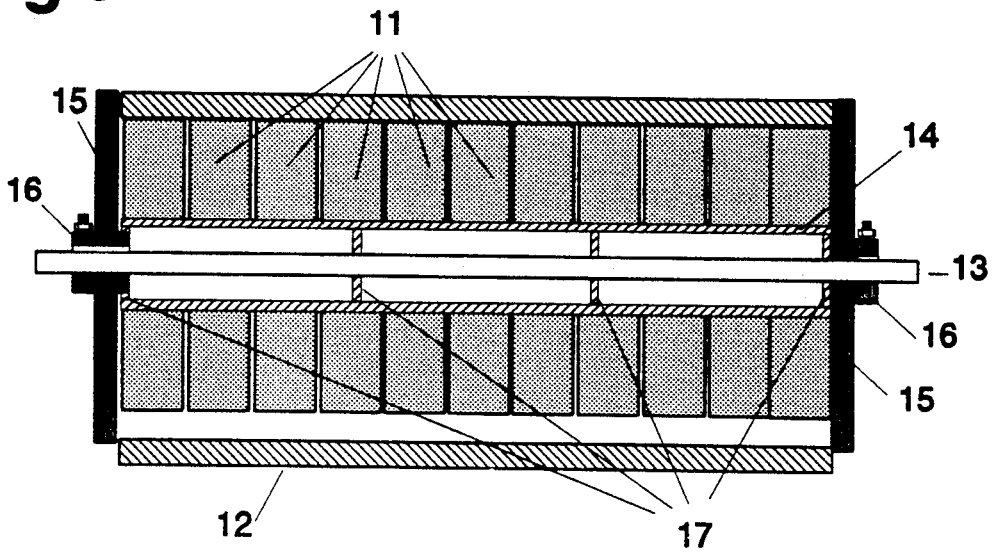
FIG. 3 shows a cut-away side view of the preferred embodiment of the roller of the invention.

In prior art devices the roller (10) was made of a hard material such as solid steel (see the above discussion of the prior art), which causes a great deal of bruising and damage to the fruit or vegetable product. The improved roller of the invention, shown in greater detail in FIGS. 2 through 4, avoids this damage by its design. The preferred embodiment of the roller is shown in FIG. 2 (end view) and FIG. 3 (side view). The following discussion relates to those figures.

The dimensions given in this description of the preferred embodiment are preferred for a roller of approximately 12" diameter and 40" length (the shaft being longer), as might be used in a separator intended for use with potatoes or other fairly large vegetables. It will be recognized by one skilled in the art that such a roller can be scaled up or down in length and thickness within the teachings of the invention, as might be required by the product to be sorted and the size and capacity of the separating machine.

The preferred embodiment of the improved roller comprises a shaft (13), which is coupled to the drive means for rotation, and is supported by appropriate bearings, etc., which are conventional and do not form part of the invention. In the preferred embodiment, the shaft is made of 1⅜" cold rolled steel.

Mounted coaxially on the shaft for rotation therewith is a rigid inner tubing (14), which reinforces the shaft (13) against the forces of the falling product/debris mixture. In the preferred embodiment, the inner tubing is cold rolled steel having a 5" outer diameter and a wall thickness of ⅛". Reinforcing disks (17) may be provided if needed to center the inner tubing on the shaft (13) and to reinforce it. If a solid inner tubing were used, the reinforcing disks would not be needed. The inner tubing is of the same length as the central portion of the shaft, which is the width of the free fall zone.

The inner tubing (14) is coaxially surrounded by resilient material which absorbs the impact of the falling product, and provides the protection from bruising. In the preferred embodiment, this is a constructed of a plurality of resilient disks (11) which are made of neoprene R-431-N. The disks of the preferred embodiment are 1.75" wide with an inner diameter (before being fit on the inner tubing) of 4.75" and an outer diameter of 11.25".

The disks are preferably of slightly smaller inner diameter than the outer diameter of the inner tubing, which means that they must be force-fit to hold tightly onto the inner tubing. Alternatively, the disks could be attached to the inner tubing by adhesive. Whichever method is used, this allows the disks to be rotated by the rotation of the inner tubing without slippage. Sufficient disks are mounted to cover substantially all of the inner tubing, and thus to underlie substantially all of the free-fall zone—23 disks are used in the preferred embodiment for a 40" wide free-fall zone.

The thickness of the disks (the distance between the outer diameter and the inner diameter) must be a substantial portion of the radius of the roller, in order for the resilient disks to provide sufficient cushioning for the product. In the preferred embodiment, the disks are 3⅛" thick (after being force-fit on the 5" diameter inner tube), out of a total radius for the roller of approximately 6".

Figure 5:
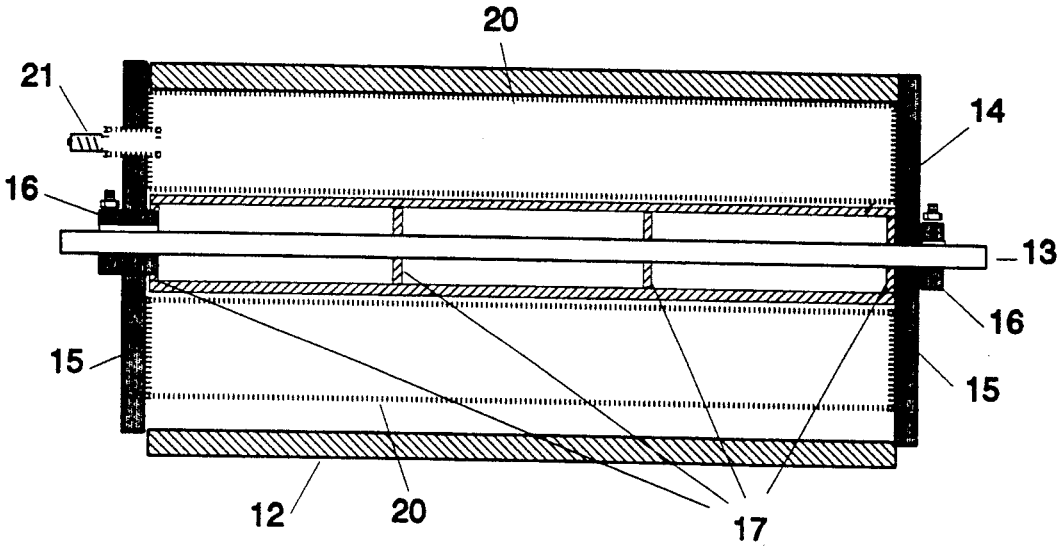
FIG. 5 shows a cut-away side view of an alternate embodiment of the roller of the invention using an inflatable tube.

It will be recognized by one skilled in the art that other materials of varying resilience may be used for the resilient material, depending on the product to be processed and the size of the roller. For products which are more easily bruised, or for a smaller product or roller, a softer product such as a sponge rubber might be used. Another option (see FIG. 5) would be to use an inflatable tube (20) containing air or other gas under pressure for the resilient material, in place of disks or sponge rubber. This would allow adjustment of the resilience by addition or bleeding of air through a valve (21) which may extend through one of the end plates (15).

The outside "bounce surface" of the roller is a loose-fitting sleeve (12). In the preferred embodiment the sleeve is a 40" long piece of polyvinyl chloride (PVC) sewer pipe, 0.375" wall thickness, having an inside diameter of 11 11/16" and an outside diameter of 12 7/16" (RT 123548 type PSM SDR 45). Other alternative materials for the sleeve within the teachings of the invention would be other forms of plastic, stainless steel, or aluminum.

The material must be substantially rigid, so that the product and debris will rebound differentially, as opposed to a soft material which would absorb all of the kinetic energy of the falling stream and would provide no differential rebound.

The sleeve (12) and disks (11) are retained on the shaft (13) and inner tubing (14) by a pair of end plates (15). The end plates are rigidly fixed to the shaft (13) by a keyed fixture (16), which forces the end plates (15), inner tubing (14) and disks (11) to rotate together. The end plates (15) are *not* connected to the sleeve (12), but are of sufficient diameter (i.e., larger than the inner diameter of the sleeve) that the sleeve (12) cannot slip past.

Thus, the sleeve (12) is constrained against axial movement along the shaft (i.e., to remain in the freefall zone) by the end-plates (15), but is free to move radially against the resilience of the disks (11) under the impact of the falling material. The disks are rotated by the shaft (13) and inner tubing (14) over which they are force-fit, and they in turn rotate the sleeve (12) because of the friction of the outer surface of the disks (11) against the inner surface of the sleeve (12).

Figure 4:
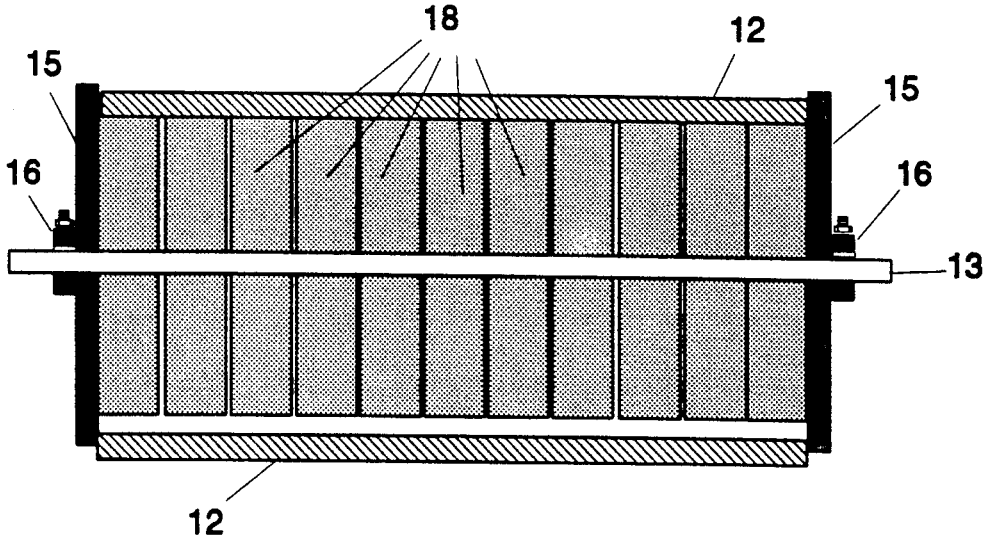
FIG. 4 shows a cut-away side view of an alternate embodiment of the roller of the invention without the inner sleeve.

FIG. 4 shows an alternative embodiment of the invention. In this embodiment, all of the features are the same as discussed above, except that the disks (18) are force-fit directly on the shaft (13), without the inner sleeve (14). This embodiment would not be desirable for the application of the preferred embodiment, since the unreinforced shaft (13) would be prone to bending or breakage given the length of the shaft and the weight of the product. However, for smaller machines sorting light products, perhaps such as small fruits or the like, the inner tubing could be eliminated as shown in FIG. 4.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. In an improved sorting apparatus for separating agricultural products from a stream of mixed agricultural products and undesirable material such as rocks or dirt clods, of the kind having a feed conveyor means for transporting an unsorted mixture of desired and undesired material to a free-fall area at a discharge end of said conveyor where said mixture leaves said conveyor and is allowed to fall freely, a rotating separation roller located under said free-fall area, positioned such that said mixture impacts on said roller and the individual components of said mixture rebound from the roller, the components rebounding in streams of varying locations depending upon the rebound characteristics of each component, diverter means located in the stream of rebounding components for separating the components into desired and undesired streams based upon the location of components within the stream, drive means for rotating said roller, and a plurality of collection means for transporting the desired and undesired streams away from the apparatus, wherein the improvement comprises an improved separation roller comprising:

a) shaft means for supporting and rotating the roller, having an outside diameter and a length with two end portions and a central portion therebetween, the central portion being at least as wide as the free-fall area at the end of the first conveyor means, the shaft means being adapted to being rotated by the drive means, b) resilient material located coaxially on the shaft means along substantially all of the central portion of the shaft means, the material having an inside diameter, and an outside diameter, with a thickness therebetween, the thickness being a substantial portion of the total radius of the separation roller, the material being adapted to being rotated by the rotation of the shaft means, c) rigid cylindrical sleeve means for rebounding the mixture located coaxially outside of the resilient material, having an inside diameter slightly larger than the outside diameter of the resilient material such that the sleeve means fits loosely over the resilient material, an outside diameter, and a thickness therebetween, and having a length substantially equal to that of the central portion of the shaft means, whereby the sleeve means is supported and rotated by the resilient material, and d) means for restraining said sleeve means from axial movement along the shaft means and allowing the sleeve means to move freely along the radius of the roller against the resilience of the resilient material.

2. The improved roller of claim 1 in which the sleeve means in constructed of polyvinyl chloride (PVC) pipe.

3. The improved roller of claim 2 in which the PVC pipe is sewer pipe.

4. The improved roller of claim 1 in which the sleeve means is constructed of aluminum tubing.

5. The improved roller of claim 1 in which the sleeve means is constructed of aluminum tubing.

6. The improved roller of claim 1 in which the resilient material comprises a plurality of disks.

7. The improved roller of claim 6 in which resilient material of which the disks are constructed is neoprene.

8. The improved roller of claim 6 in which the inside diameter of the disks is slightly smaller than the outside diameter of the shaft means, whereby the disks are supported directly on the shaft means and fit tightly on said shaft means to be rotated directly thereby.

9. The improved roller of claim 1 in which resilient material is sponge rubber.

10. The improved roller of claim 1 in which resilient material is an inflatable tube containing gas under pressure.

11. The improved roller of claim 1 further comprising cylindrical inner tubing means located coaxially on the central portion of the shaft means inside the resilient material, having a length substantially equal to the length of the central portion of the shaft means, an inside diameter substantially equal to the outside diameter of the shaft means and an outside diameter slightly larger than the inside diameter of the resilient material, whereby the resilient material fits tightly on the inner tubing means and is supported and rotated by the inner tubing means.

12. The improved roller of claim 11 in which the inner tubing means is fixedly attached to the shaft means for rotation thereby.

13. The improved roller of claim 1 in which the means to restrain axial movement of the sleeve means comprises end plate means having an outside diameter greater than the inner diameter of the sleeve means.

14. A sorting apparatus for separating agricultural products from a stream of mixed agricultural products and undesirable material such as rocks or dirt clods, comprising:

a) a feed conveyor means for transporting an unsorted mixture of desired and undesired material to a free-fall area at a discharge end of said conveyor where said mixture leaves said conveyor and is allowed to fall freely, b) a rotating separation roller located under said free-fall area, positioned such that said mixture impacts on said roller and the individual components of said mixture rebounds from the roller, the components rebounding in streams of varying locations depending upon the rebound characteristics of each component, said roller comprising:

i) shaft means for supporting and rotating the roller, having an outside diameter and a length with two end portions and a central portion therebetween, the central portion being at least as wide as the free-fall area at the end of the first conveyor means, the shaft means being adapted to being rotated by the drive means, ii) resilient material located coaxially on the shaft means along substantially all of the central portion of the shaft means, the material having an inside diameter, and an outside diameter, with a thickness therebetween, the thickness being a substantial portion of the total radius of the separation roller, the material being adapted to being rotated by the rotation of the shaft means, iii) rigid cylindrical sleeve means for rebounding the mixture located coaxially outside of the resilient material, having an inside diameter slightly larger than the outside diameter of the resilient material such that the sleeve means fits loosely over the resilient material, an outside diameter, and a thickness therebetween, and having a length substantially equal to that of the central portion of the shaft means, whereby the sleeve means is supported and rotated by the resilient material, and iv) means for restraining said sleeve means from axial movement along the shaft means and allowing the sleeve means to move freely along the radius of the roller against the resilience of the resilient material, c) diverter means located in the stream of rebounding components for separating the components into desire d and undesired streams based upon the location of the components within the stream, d) drive means for rotating said roller, operatively connected to said roller for rotation thereof, and e) a plurality of conveyor means for collecting the desired and undesired streams.

15. The sorting apparatus of claim 14 in which the sleeve means is constructed of polyvinyl chloride (PVC) pipe.

16. The sorting apparatus of claim 15 in which the PVC pipe is sewer pipe.

17. The sorting apparatus of claim 14 in which the sleeve means is constructed of stainless steel tubing.

18. The sorting apparatus of claim 14 in which the sleeve means is constructed of aluminum tubing.

19. The improved roller of claim 14 in which the resilient material comprises a plurality of disks.

20. The sorting apparatus of claim 19 in which resilient material of which the disks are constructed is neoprene.

21. The sorting apparatus of claim 14 in which resilient material is sponge rubber.

22. The sorting apparatus of claim 14 in which resilient material is an inflatable tube containing gas under pressure.

23. The sorting apparatus of claim 14 in which the inside diameter of the resilient material is slightly smaller than the outside diameter of the shaft means, whereby the resilient material is supported directly on the shaft means and fits tightly on said shaft means to be rotated directly thereby.

24. The sorting apparatus of claim 14 further comprising cylindrical inner tubing means located coaxially on the central portion of the shaft means inside the disks, having a length substantially equal to the length of the central portion of the shaft means, an inside diameter substantially equal to the outside diameter of the shaft means and an outside diameter slightly larger than the inside diameter of the disks, whereby the disks fit tightly on the inner tubing means and are supported and rotated by the inner tubing means.

25. The improved roller of claim 24 in which the inner tubing means is fixedly attached to the shaft means for rotation thereby.

26. The improved roller of claim 14 in which the means to restrain axial movement of the sleeve means comprises end plate means having an outside diameter greater than the inner diameter of the sleeve means.

27. A method of separating agricultural products from a stream of mixed agricultural products and undesirable material such as rocks or dirt clods, comprising the steps of:

a) feeding an unsorted mixture of desired and undesired material to a free-fall area where said mixture is allowed to fall freely, b) impacting said unsorted mixture upon a rotating separation roller located under said free-fall area, such that said mixture impacts on said roller and the individual components of said mixture rebound from the roller, the components rebounding in streams of varying locations depending upon the rebound characteristics of each component, the separation roller having i) shaft means for supporting and rotating the roller, having an outside diameter and a length with two end portions and a central portion therebetween, the central portion being at least as wide as the free-fall area, the shaft means being adapted to being rotated by a drive means, ii) resilient material located coaxially on the shaft means along substantially all of the central portion of the shaft means, the material having an inside diameter, and an outside diameter, with a thickness therebetween, the thickness being a substantial portion of the total radius of the separation roller, the material being adapted to being rotated by the rotation of the shaft means, iii) rigid cylindrical sleeve means for rebounding the mixture located coaxially outside of the resilient material, having an inside diameter slightly larger than the outside diameter of the resilient material such that the sleeve means fits loosely over the resilient material, an outside diameter, and a thickness therebetween, and having a length substantially equal to that of the central portion of the shaft means, whereby the sleeve means is supported and rotated by the resilient material, and iv) means for restraining said sleeve means from axial movement along the shaft means and allowing the sleeve means to move freely along the radius of the roller against the resilience of the resilient material, c) collecting the stream of desired product rebounding from the separation roller.

* * * * *